US008656533B2

(12) United States Patent
Grossman et al.

(10) Patent No.: US 8,656,533 B2
(45) Date of Patent: Feb. 25, 2014

(54) PANELS, OVERLAYS, AND INSERTS FOR FURNITURE ASSEMBLIES, AND RELATED METHODS

(75) Inventors: Joel Grossman, Selangor (MY); Mike Gallawa, Ridgefield, WA (US); Howard Porter, Kuala Lumpur (MY)

(73) Assignee: Night and Day Furniture LLC, Vancouver, WA (US)

( * ) Notice: Subject to any disclaimer, the term of this patent is extended or adjusted under 35 U.S.C. 154(b) by 0 days.

(21) Appl. No.: 12/076,760

(22) Filed: Mar. 21, 2008

(65) Prior Publication Data

US 2009/0235462 A1 Sep. 24, 2009

(51) Int. Cl.
*A47C 19/00* (2006.01)
*A47C 23/00* (2006.01)

(52) U.S. Cl.
USPC ..... 5/280; 5/308; 5/58; 5/285; 5/493; 5/53.1

(58) Field of Classification Search
USPC ..... 5/308, 280, 58, 285, 493, 53.1; 312/204, 265.6, 311; 297/452.38; D6/384
See application file for complete search history.

(56) References Cited

U.S. PATENT DOCUMENTS 1,245,484 A * 11/1917 Martin ..... 5/131
1,282,281 A * 10/1918 Pennington ..... 5/131
1,815,616 A * 7/1931 Feldman ..... 5/308
1,866,953 A * 7/1932 Stephens ..... 5/308
2,267,176 A * 12/1941 Turner ..... 5/93.1
2,784,421 A * 3/1957 Fredman ..... 5/131
3,414,912 A * 12/1968 Dusey, Sr. ..... 5/52
4,103,375 A * 8/1978 Santo ..... 5/675
4,523,787 A * 6/1985 Robinson ..... 297/440.2
4,597,122 A * 7/1986 Handler et al. ..... 5/503.1
4,882,796 A * 11/1989 McNeal et al. ..... 5/8
5,474,377 A * 12/1995 Cone et al. ..... 312/326
5,520,436 A * 5/1996 Rader et al. ..... 297/188.11
7,159,253 B2 * 1/2007 Yang ..... 5/53.1

FOREIGN PATENT DOCUMENTS

GB 2076280 * 12/1981 ..... 5/308

* cited by examiner

*Primary Examiner* — Robert G Santos
*Assistant Examiner* — David E Sosnowski
(74) *Attorney, Agent, or Firm* — Harness, Dickey & Pierce P.L.C.

(57) ABSTRACT

A furniture assembly may generally include a frame having legs for supporting the frame. The legs may generally define a space under the frame. A panel may be configured to be coupled to the frame to conceal at least part of the space under the frame. A furniture assembly may also, or alternatively, generally include a frame having a surface, and an overlay configured to be coupled to the frame to cover at least part of the surface of the frame. The overlay may provide a select appearance to the frame at the surface. A furniture assembly may further, or alternatively, generally include a frame having an opening, and an insert configured to be coupled to the frame at the opening. The insert may provide a select appearance to the frame at the opening.

22 Claims, 11 Drawing Sheets

PANELS, OVERLAYS, AND INSERTS FOR FURNITURE ASSEMBLIES, AND RELATED METHODS

FIELD

Example embodiments generally relate to furniture assemblies, and more particularly to panels that can be coupled to furniture assembly frames for concealing at least part of spaces under the frames, and to overlays and inserts that can be coupled to furniture assembly frames for providing select appearances to the frames.

BACKGROUND

The statements in this section merely provide background information related to the present disclosure and may not constitute prior art.

Furniture assemblies such as, for example, beds, futons, dressers, etc. may include spaces under the assemblies that can be used, for example, to store desired items under the assemblies. Storage containers may be received within these spaces to hold the desired items under the assemblies. Hardware (e.g., rollers, wheels, etc.) may be included on the storage containers to help move the storage containers into and out of the spaces as desired. This hardware, however, may be undesirably visible under the assemblies to an observer.

Furniture assemblies may also include frames having one or more surfaces visible to an observer. However, one or more of these visible surfaces may include an appearance that is undesirable to the observer.

SUMMARY

Example embodiments generally relate to furniture assemblies. In example embodiments, a furniture assembly generally includes a frame having legs for supporting the frame. The legs generally define a space under the frame. A panel is configured to be coupled to the frame to conceal at least part of the space under the frame.

In example embodiments, a furniture assembly generally includes a frame having a surface, and an overlay configured to be coupled to the frame to cover at least part of the surface of the frame. The overlay provides a select appearance to the frame at the surface.

Other example embodiments generally relate to panel assemblies for concealing at least part of a space under a frame of a furniture assembly. The furniture assembly frame may have legs supporting the frame and defining the space generally under the furniture assembly frame. In example embodiments, a panel assembly generally includes a panel configured to extend generally between at least two legs of a furniture assembly frame for concealing at least part of a space under the furniture assembly frame. At least one fastener is configured to couple the panel to the furniture assembly frame.

Example embodiments generally relate to overlay assemblies for providing one or more select appearances to furniture assembly frames over surfaces of the furniture assembly frames. In example embodiments, an overlay assembly generally includes an overlay configured to cover at least part of a surface of a furniture assembly frame to provide the one or more select appearances to the furniture assembly frame at the surface.

Example embodiments generally relate to methods for concealing at least part of a space under a frame of a furniture assembly. The frame may include legs supporting the frame and defining the space generally under the frame. In example embodiments, a method for concealing at least part of a space under a frame of a furniture assembly generally includes coupling a panel to the frame generally between two legs of the frame.

Example embodiments generally relate to furniture assemblies generally having a frame having an opening, and an insert configured to be coupled to the frame at the opening. The insert may provide a select appearance to the frame at the opening.

Example embodiments generally relate to insert assemblies for providing one or more select appearances to furniture assembly frames at an opening in the furniture assembly frames. The insert assemblies may generally include an insert configured to be coupled to the furniture assembly frame within the opening of the furniture assembly frame to provide the one or more select appearances to the furniture assembly frame at the opening.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely an example in nature and is not intended to limit the present disclosure, application, or uses.

Example embodiments will now be described more fully with reference to the accompanying drawings. Example embodiments may, however, be embodied in many different forms and should not be construed as being limited to example embodiments set forth herein. Rather, these example embodiments are provided so that this disclosure will be thorough, and will fully convey the concept of the disclosure to those skilled in the art.

According to various aspects, example embodiments are provided of furniture assemblies. In example embodiments, a furniture assembly may generally include a panel for concealing from view at least part of a space located under the furniture assembly. A storage container may be positioned at least partly within the space under the furniture assembly for use in storing items under the furniture assembly. The panel may substantially conceal from view hardware used, for example, to move the storage container into and/or out of the space under the furniture assembly. In other example embodiments, furniture assemblies may include more than one panel, more than one storage container, etc.

In example embodiments, a furniture assembly may generally include an overlay for providing a select appearance to the furniture assembly. For example, the overlay may be coupled to a surface of a frame of the furniture assembly for changing, altering, defining, etc. an appearance of the furniture assembly frame. In other example embodiments, furniture assemblies may include more than one overlay for providing a select appearance to one or more surfaces of the furniture assembly's frame.

In example embodiments, a furniture assembly may generally include an insert for providing a select appearance to the furniture assembly. For example, the insert may be coupled to the frame of the furniture assembly for changing, altering, defining, etc. an appearance of the furniture assembly frame. In other example embodiments, furniture assemblies may include more than one insert for providing one or more select appearances to the furniture assembly's frame.

In example embodiments, a furniture assembly may generally include a panel for concealing from view at least part of a space located under the furniture assembly. The panel may also include an overlay for providing a select appearance to the furniture assembly.

In example embodiments, a furniture assembly may generally include a panel for concealing from view at least part of a space located under the furniture assembly. The panel may also include an insert for providing a select appearance to the furniture assembly.

Figure 1:
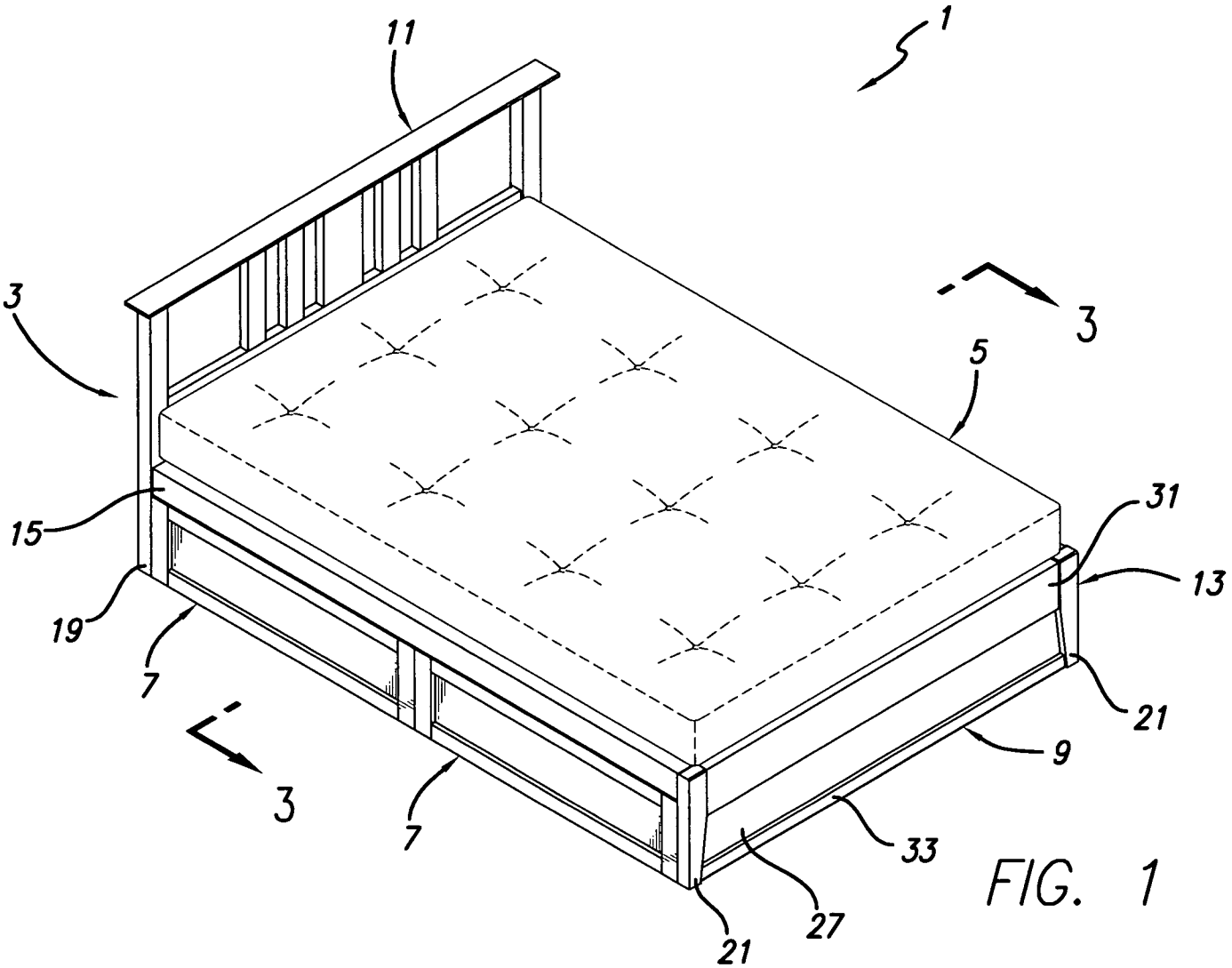
FIG. 1 is an example perspective view of example embodiments of a bed having storage containers positioned under the bed and a footboard panel concealing from view at least part of the storage containers positioned under the bed.
Figure 2:
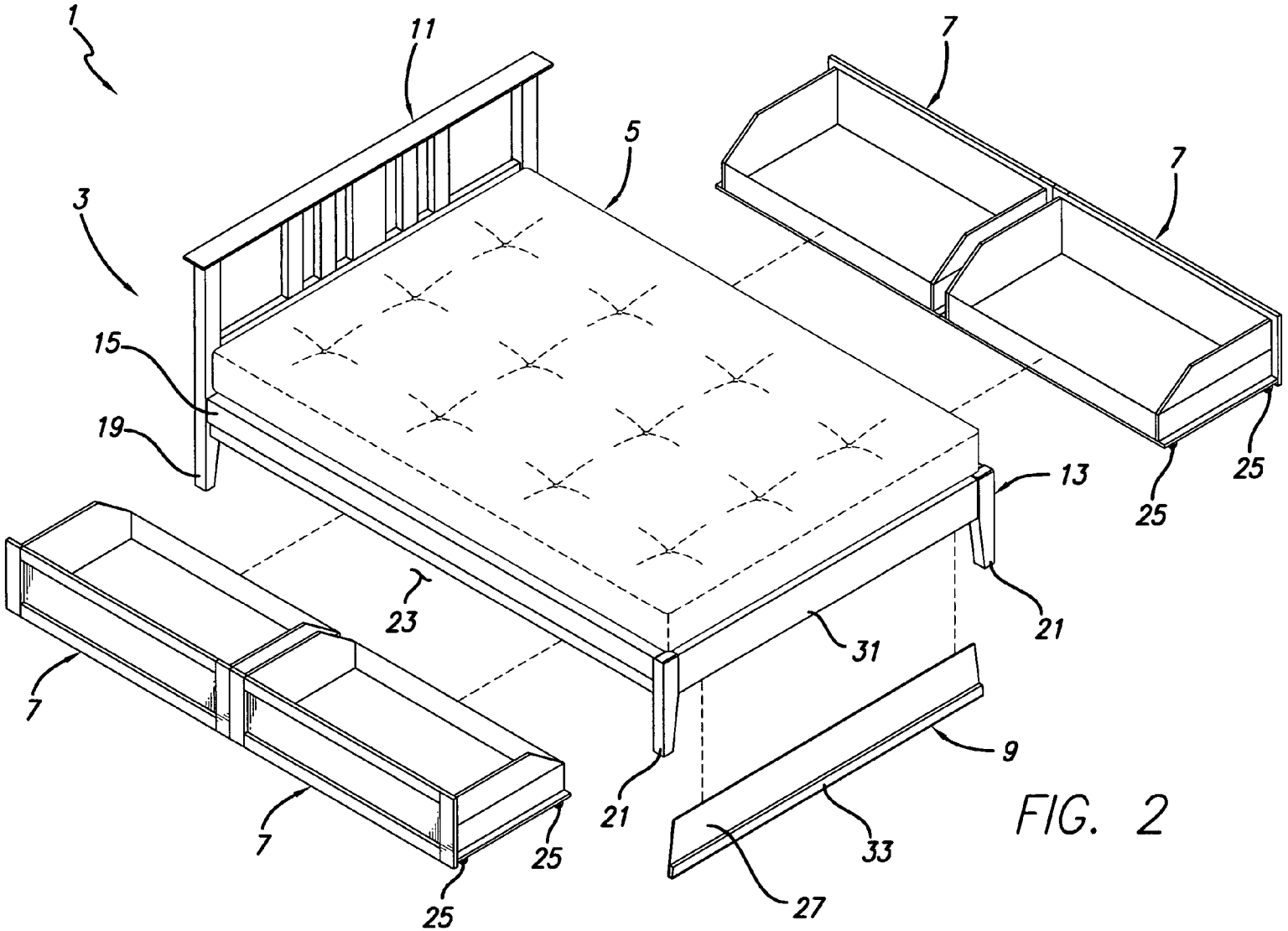
FIG. 2 is an example perspective view similar to FIG. 1 with the storage containers moved laterally outward of the bed and the panel moved away from the bed.
Figure 3:
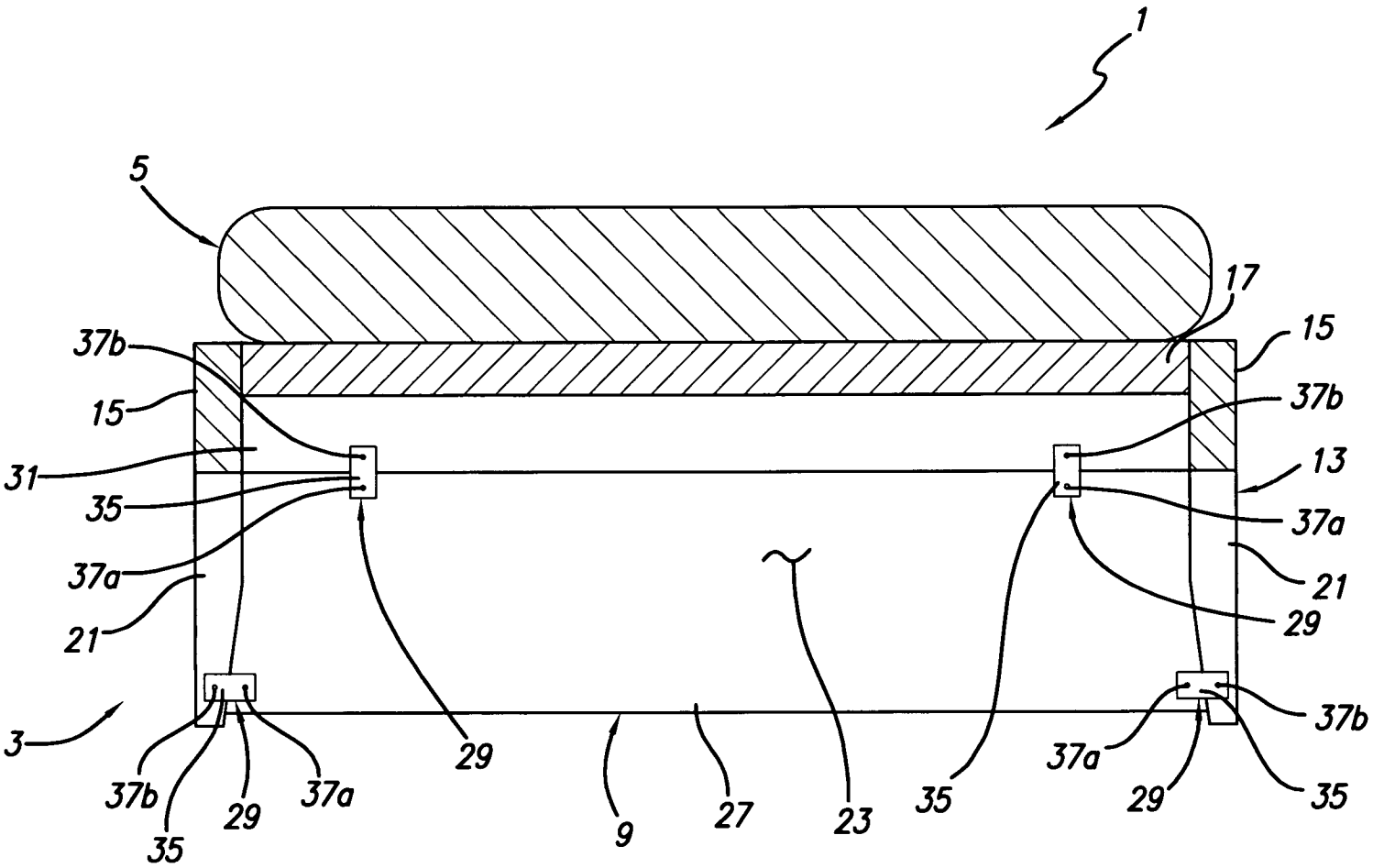
FIG. 3 is an example cross-section view taken in a plane including line 3-3 in FIG. 1 with the storage containers removed.

Referring now to the drawings, FIGS. 1-3 illustrate an example embodiment of a furniture assembly embodying one or more aspects of the present disclosure. In this example embodiment, the furniture assembly includes, for example, a bed 1. The example bed 1 generally includes a frame 3 and a mattress 5 supported by the frame 3. Storage containers (for example four storage containers, each indicated at 7) may be received at least partly under the bed 1, and a panel assembly 9 may be provided for concealing from view at least part of one or more of the storage containers 7 under the bed 1.

The frame 3 of the bed 1 generally includes a headboard 11, a footboard 13, and two side rails (each indicated at 15) coupled between the headboard 11 and the footboard 13 (e.g., using suitable fasteners, connectors, epoxy, constructions, etc.). A mattress platform 17 is supported by the headboard 11, footboard 13, and/or side rails 15 for supporting the mattress 5 on the frame 3. The mattress platform 17, for example, may rest on top of at least part of the headboard 11, footboard, and/or side rails 15, may be coupled at least partly thereto (e.g., using suitable fasteners, connectors, epoxy, constructions, etc.), may be formed integrally at least partly therewith, etc. within the scope of the present disclosure. The headboard 11 includes legs 19 and the footboard 13 includes legs 21 which support the headboard 11, footboard 13, side rails 15, and mattress platform 17 over, for example, a surface (e.g., a floor, etc.), etc. The legs 19 and 21 thus generally define a space 23 under the frame 3 (FIG. 3). In other example embodiments, beds may include frames having legs arranged differently than disclosed herein (e.g., more or less than four legs, legs positioned differently, etc.).

The mattress 5 of the bed 1 may include any suitable mattress type, size, etc. for use in sitting, lying, etc. on the bed 1. In addition, the mattress 5 may directly contact the mattress platform 17 of the bed 1, or one or more intervening components may be included therebetween (e.g., pads, sheets, liners, supports, etc.).

As shown in FIGS. 1 and 2, the four storage containers 7 are each configured (e.g., sized, shaped, constructed, etc.) to be received at least partly under the bed 1; and more particularly, at least partly within the space 23 defined under the frame 3 of the bed 1 (e.g., at least partly under the mattress platform 17 of the bed's frame 3, etc.). Two of the storage containers 7 may be received at least partly under each lateral side of the frame 3, generally between the headboard 11 and the footboard 13 (e.g., between a leg 19 of the headboard 11 and a leg 21 of the footboard 13, etc.). In other example embodiments, beds may be configured to receive more than or less than four total storage containers at least partly under the beds. In still other example embodiments, beds may be configured to receive storage containers under the beds in different arrangements than disclosed herein.

Each storage container 7 may be generally rectangular in shape and is generally configured (e.g., sized, shaped constructed, etc.) to define an interior compartment for storing, holding, retaining, etc. items (e.g., clothing, bedding, etc.) within the container. Rollers 25 (broadly, hardware) are coupled under each storage container 7 for rolling each storage container 7 over, for example, a surface and for helping improve mobility of the storage container 7. The storage containers 7 may each be positioned generally under the bed 1 (e.g., generally under the mattress platform 17 of the bed's frame 3) for storing, holding, retaining, etc. the items within the storage containers 7 under the bed 1 (FIG. 1). The storage containers 7 may each be moved (e.g., rolled, etc.) relative to the bed's frame 3 laterally outward of the frame 3 for allowing access to the items in the storage containers 7 and/or for inserting, removing, etc. items into/from the storage containers 7 (FIG. 2). Each storage container 7 may also include one or more handles, grips, etc. within the scope of the present disclosure to allow a user to grasp and move the storage containers 7 as desired. In other example embodiments, storage containers may include rollers different than disclosed herein, wheels, sliders, etc. for use in moving the storage containers over surfaces.

With additional reference to FIG. 3, the panel assembly 9 of the bed 1 can conceal from view at least part of the space 23 under the bed's frame 3 (and at least part of any storage container 7 received within the space 23). The illustrated panel assembly 9 generally includes a panel 27 configured (e.g., sized, shaped, constructed, etc.) to be coupled to the bed's footboard 13 by, for example, fasteners 29. The panel 27 may thus conceal at least part of the space 23 under the bed's frame 3, and at least part of any storage container 7 and its rollers 25 received within the space 23, from view under the footboard 13. This may provide a cleaner look to the bed 1 (and under the bed 1) from vantage points around the bed 1. A panel assembly may also be configured (e.g., sized, shaped, constructed, etc.) to be coupled to the headboard 11 of the bed's frame 3 within the scope of the present disclosure. Such a headboard panel assembly could conceal at least part of the space 23 under the bed's frame 3, and at least part of any storage containers 7 and their rollers received in the space 23, from view under the bed's headboard 11. In other example embodiments, panel assemblies may include panels coupled to furniture assembly frames without use of fasteners. For example, a press-fit coupling, etc. may be used to couple the panels to the frames.

The panel 27 of the illustrated panel assembly 9 may be thin and generally planar in shape, and may be configured (e.g., sized, shaped, constructed, etc.) to fit substantially between the legs 21 of the footboard 13. Lateral sides of the panel 27 are configured (e.g., sized, shaped, constructed, etc.) to fit closely adjacent the legs 21 (e.g., abut, etc.), and an upper portion of the panel 27 is configured (e.g., sized, shaped, constructed, etc.) to fit closely adjacent a rail 31 of the footboard 13 (e.g., abut, etc.). Together, these close fits help substantially conceal and block from view the space 23 under the bed 1 (as viewed under the footboard 13).

The panel assembly 9 also includes a support 33 extending along a lower portion of the panel 27, for example, for providing stability, support, etc. to the panel 27. The support 33, however, may be located differently along the panel 27 within the scope of the present disclosure. Further, one or more additional supports 33 may be provided on and/or along the panel 27 within the scope of the present disclosure (e.g., along an upper portion of the panel 27, along sides of the panel 27, across the panel 27, etc.). Moreover, a panel assembly may not include any supports within the scope of the present disclosure.

As best shown in FIG. 3, four fasteners 29 may be provided for coupling the panel 27 to the bed's footboard 13. Two of the fasteners 29 may be positioned generally along an upper portion of the panel 27, and one of the fasteners 29 is positioned generally along each lateral side of the panel 27, generally adjacent a lower portion of the panel 27. Different numbers of fasteners may be used for coupling panels to footboards within the scope of the present disclosure. And fasteners may be positioned differently than disclosed herein without departing from the scope of the present disclosure.

The illustrated fasteners 29 each include a plate 35 configured (e.g., sized, shaped, constructed, etc.) to receive, for example, screws 37*a*, 37*b* through the plate 35. One screw 37*a* couples the plate 35 to the panel 27, and another screw 37*b* then couples the plate 35 and panel 27 to the bed's footboard 13. The fasteners 29 along the upper portion of the panel 27 couple to the footboard rail 31. The fasteners 29 along each lateral side of the panel 27 couple to the legs 21 of the footboard 13. Different fasteners may be used, including, for example, different plates, nails, adhesives, hooks-and-loops, etc. within the scope of the present disclosure. In addition, fasteners may couple to one or more different components of a bed's frame without departing from the scope of the present disclosures.

In other example embodiments, furniture assemblies may include panel assemblies having more than one panel and/or more than one support. In still other example embodiments, furniture assemblies may include panel assemblies configured (e.g., sized, shaped, constructed, etc.) to be coupled to frames of the furniture assemblies differently than disclosed herein. For example, panel assemblies may couple to different parts of the frames (e.g., to different parts of the footboards, to different parts of the legs of the footboards, to headboards, to rails, etc.), etc.

In still further example embodiments, furniture assemblies may include different numbers, orientations, etc. of legs than disclosed herein. For example, in one embodiment a furniture assembly frame may include three generally aligned legs along a length of the frame (e.g., two end legs and an intermediate leg between the end legs, etc.). Here, a panel assembly may be coupled to the frame between each pair of adjacent legs. And together the two panel assemblies may extend substantially along the length of the frame between the end legs of the frame. Alternatively, a single panel assembly may be coupled to the frame substantially along the length of the frame between the end legs of the frame. Here, the single panel assembly may be configured (e.g., sized, shaped, constructed, etc.) to accommodate the intermediate leg of the frame and/or the single panel may be coupled to the end legs so as to extend past the intermediate leg without interference.

Figure 4:
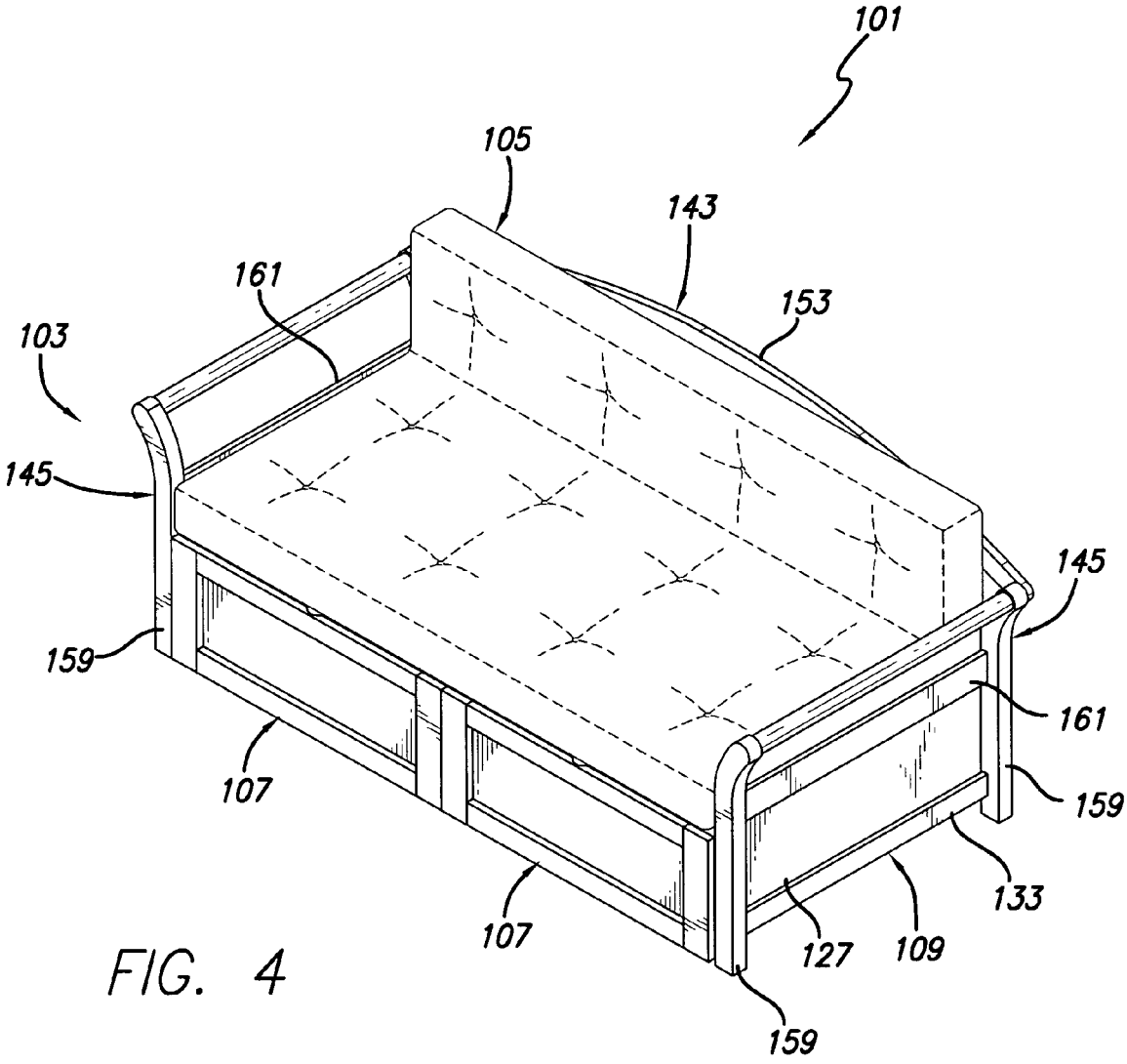
FIG. 4 is an example perspective view of example embodiments of a daybed having storage containers positioned under the daybed and panels concealing from view at least part of the storage containers positioned under the daybed.
Figure 5:
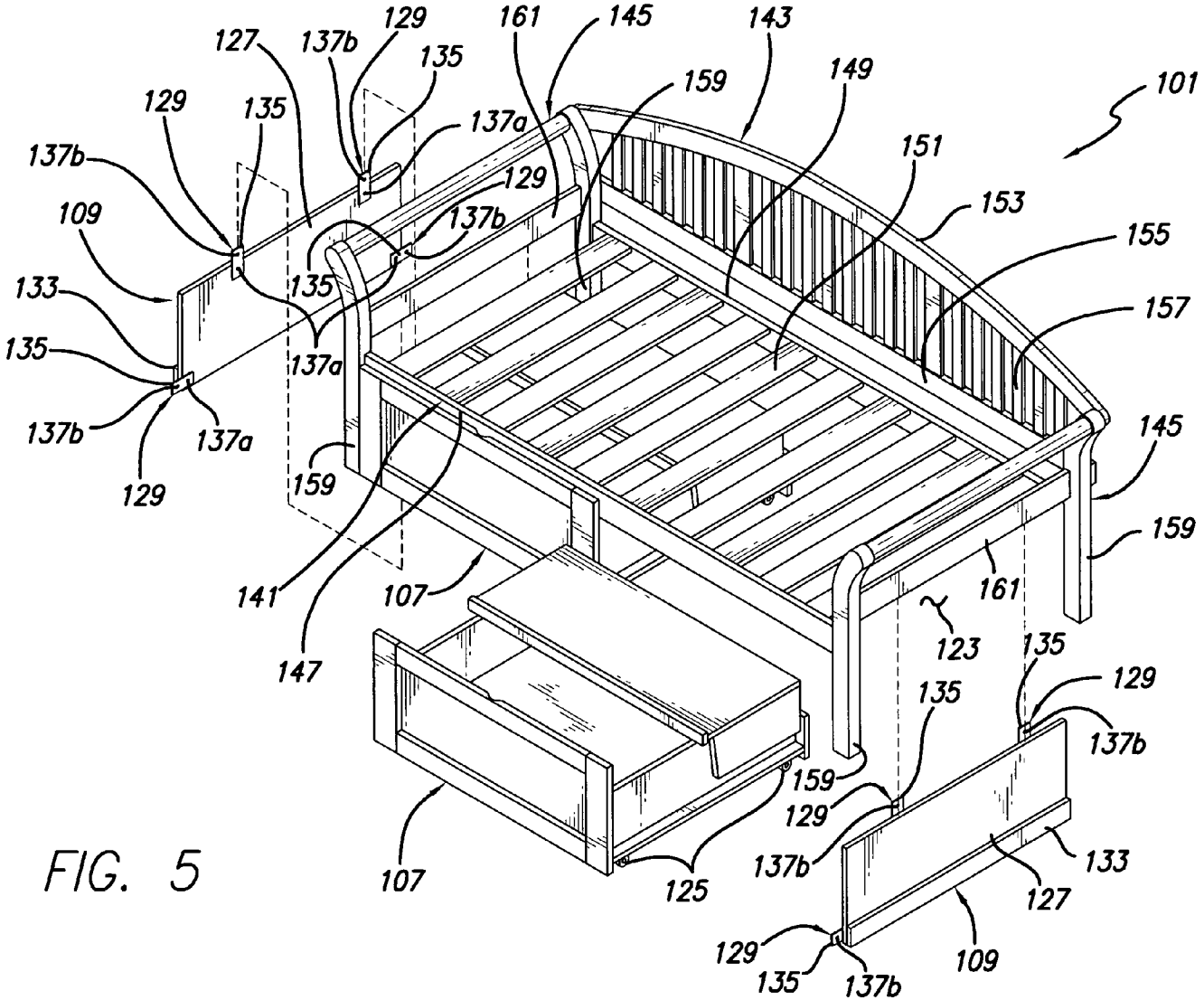
FIG. 5 is an example perspective view similar to FIG. 4 with a mattress of the daybed removed, and a storage container moved forward of the daybed and the panels each moved away from the daybed.

FIGS. 4 and 5 illustrate another example embodiment of a furniture assembly embodying one or more aspects of the present disclosure. In example embodiments, the furniture assembly includes, for example, a daybed 101. The example daybed 101 generally includes a frame 103 and a mattress 105 positioned at least partly on the frame 103. Storage containers (for example two storage containers, each indicated at 107) may be received at least partly under the daybed 101, and panel assemblies (for example two panel assemblies, each indicated at 109) may be provided for concealing from view at least part of one or more of the storage containers 107 under the daybed 101.

As best shown in FIG. 5, the frame 103 of the daybed 101 generally includes a bed platform 141, a back support 143, and two arm supports 145 connecting the bed platform 141 and back support 143 (e.g., using suitable fasteners, connectors, epoxy, etc.). The bed platform 141 includes forward and rearward opposing border rails 147 and 149 connecting multiple slats 151 therebetween (e.g., using suitable fasteners, connectors, epoxy, etc.) for supporting at least part of the mattress 105 thereon. Similarly, the back support 143 includes upper and lower border rails 153 and 155 also connecting multiple slats 157 therebetween (e.g., using suitable fasteners, connectors, epoxy, etc.) on/against which at least part of the mattress 105 may be selectively positioned and/or supported. The arm supports 145 each include two legs (each indicated at 159) that together support the bed platform 141 and back support 143 over, for example, a surface (e.g., a floor, etc.), etc. The legs 159 thus generally define a space 123 under the frame 103 (FIG. 5).

The mattress 105 of the illustrated daybed 101 may include any suitable mattress type, size, etc. for use in sitting, lying, etc. on the daybed 101. For example, the mattress 105 may include a full size futon mattress capable of positioning substantially on/over the daybed's bed platform 141 as well as on/against the daybed's back support 143. The futon mattress may be at least partly formable to the configuration of the bed platform 141 and back support 143 such that the mattress folds at about where the back support 143 and bed platform 141 connect.

As shown in FIGS. 4 and 5, the two storage containers 107 may each be configured (e.g., sized, shaped, constructed, etc.) to be received at least partly under the daybed 101; and more particularly, at least partly within the space 123 defined under the frame 103 of the daybed 101 (e.g., at least partly under the bed platform 141 of the daybed's frame 103, etc.). In the illustrated embodiment, the two storage containers 107 are received at least partly under a forward side of the daybed's frame 103.

Each storage container 107 may be generally rectangular in shape and is generally configured (e.g., sized, shaped, constructed, etc.) to define an interior compartment for storing, holding, retaining, etc. items (e.g., clothing, bedding, etc.) within the container 107. Rollers 125 (broadly, hardware) are coupled under each storage container 107 for rolling each storage container over, for example, a surface and for helping improve mobility of the storage container 107. The storage containers 107 may each be positioned generally under the daybed 101 (e.g., generally under the bed platform 141 of the daybed's frame 103) for storing, holding, retaining, etc. the items within the storage containers 107 under the daybed 101 (FIG. 4). The storage containers 107 may each be moved (e.g., rolled, etc.) relative to the daybed's frame 103 forward of the frame 103 for allowing access to the items in the storage containers 107 and/or for inserting, removing, etc. items into/from the storage containers 107 (FIG. 5).

The panel assemblies 109 of the daybed 101 may conceal from view at least part of the space 123 under the daybed's frame 103 (and at least part of any storage container 107 received within the space 123). The illustrated panel assemblies 109 each generally include a panel 127 configured (e.g., sized, shaped, constructed, etc.) to be coupled to one of the daybed's arm supports 145 by, for example, fasteners 129. As best shown in FIG. 4, the panels 127 may thus conceal at least part of the space 123 under the daybed's frame 103, and at least part of any storage container 107 and its rollers 125 received within the space 123, from view under the arm supports 145. This may provide a cleaner look to the daybed 101 (and under the daybed 101) from vantage points around the daybed 101. A panel assembly may also be configured (e.g., sized, shaped, constructed, etc.) to be coupled to a rearward side of the daybed 101 between rearward legs 159 of each of the two arm supports 145 within the scope of the present disclosure. Such a rearward panel could conceal at least part of the space 123 under the daybed's frame 103, and at least part of any storage containers 107 and their rollers 125 received in the space 123, from view behind the daybed 101.

The panels 127 of the illustrated panel assemblies 109 may each be thin and generally planar in shape, and may each be configured (e.g., sized, shaped, constructed, etc.) to fit substantially between the legs 159 of the arm supports 145. Lateral sides of each of the panels 127 are configured (e.g., sized, shaped, constructed, etc.) to fit closely adjacent the legs 159 (e.g., abut, etc.), and an upper portion of each of the panels 127 is configured (e.g., sized, shaped, constructed, etc.) to fit closely adjacent a lateral brace 161 of the respective arm support 145. Together, these close fits help substantially conceal and block from view the space 123 under the daybed 101 (as viewed under the arm supports 145). A support 133 also extends along a lower portion of each panel 127, for example, for providing stability, support, etc. to the panel 127.

As best shown in FIG. 5, four fasteners 129 may be provided for coupling each of the panels 127 to the daybed's arm supports 145. For each panel 127, two of the fasteners 129 may be positioned generally along an upper portion of the panel 127, and one of the fasteners 129 may be positioned generally along each lateral side of the panel 127, generally adjacent a lower portion of the panel 127. In other example embodiments, panel assemblies may include panels coupled to furniture assembly frames without use of fasteners. For example, a press-fit coupling, etc. may be used to couple the panels to the frames.

The illustrated fasteners 129 may each include a plate 135 configured (e.g., sized, shaped, constructed, etc.) to receive two screws 137*a*, 137*b* through the plate 135. One screw 137*a* couples the plate 135 to the respective panel 127, and another screw 137*b* then couples the plate 135 and the respective panel 127 to one of the daybed's arm supports 145. The fasteners 129 along the upper portion of each panel 127 couple to the lateral brace 161 of the respective arm support 145. The fasteners 129 along each lateral side of each panel 127 couple to the legs 159 of the respective arm supports 145.

Figure 6:
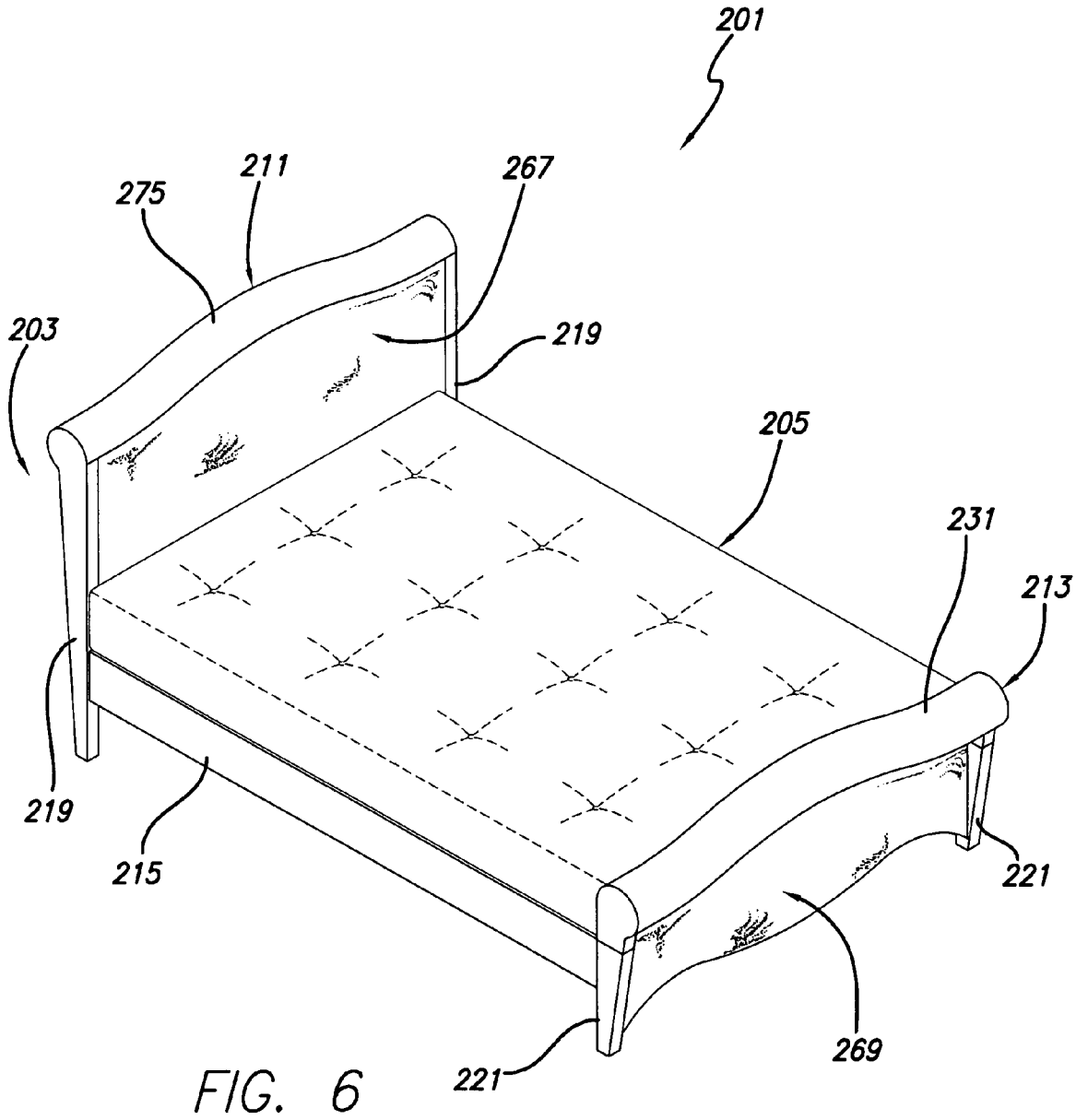
FIG. 6 is an example perspective view of example embodiments of a bed having an overlay coupled to each of a headboard and a footboard of the bed for providing a select appearance to each of the headboard and the footboard.
Figure 7:
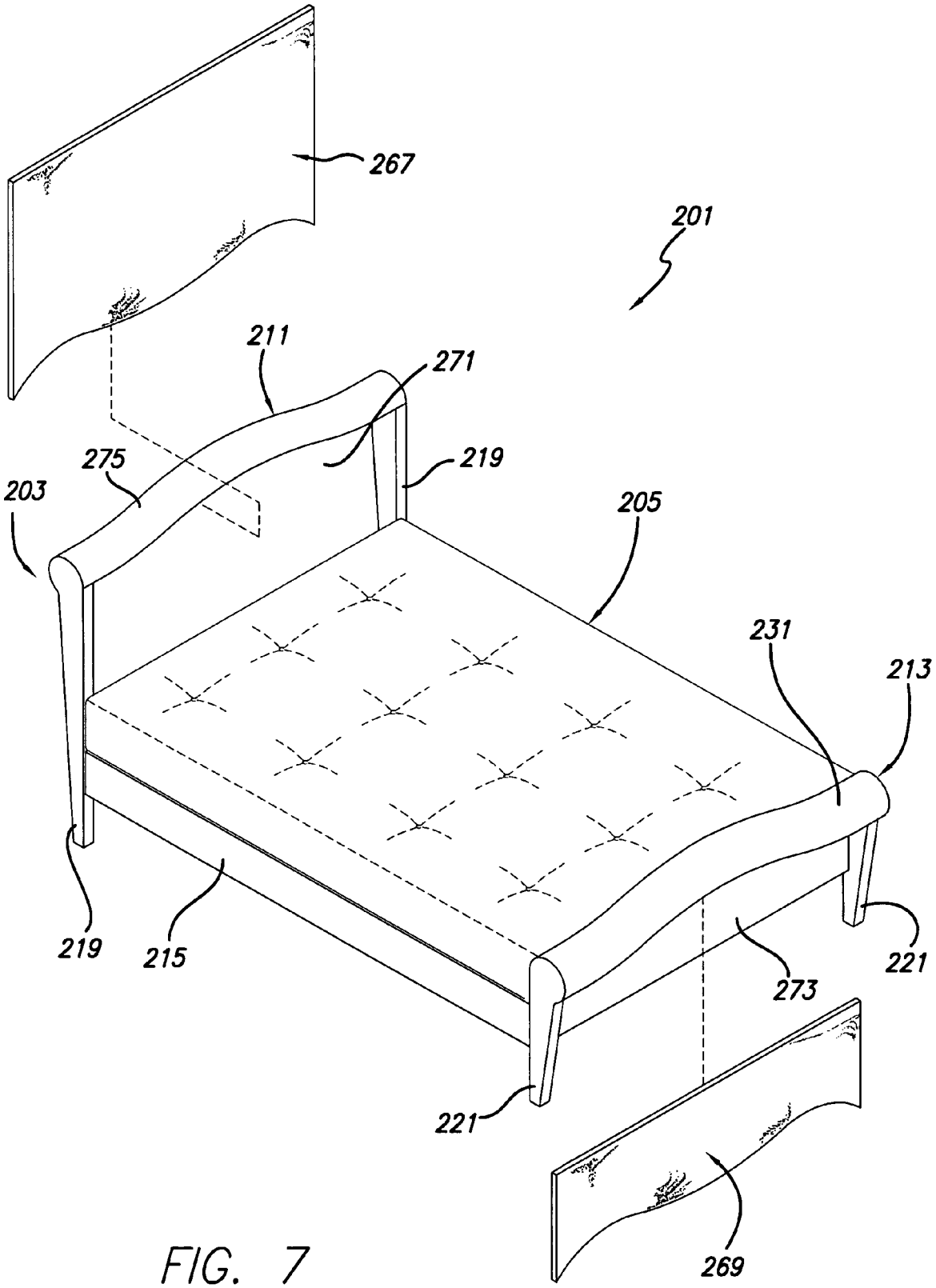
FIG. 7 is an example perspective view similar to FIG. 6 with the overlays each moved away from the bed.

FIGS. 6 and 7 illustrate another example embodiment of a furniture assembly embodying one or more aspects of the present disclosure. In example embodiments, the furniture assembly includes, for example, a bed 201. The example bed 201 generally includes a frame 203 and a mattress 205 supported by the frame 203. Two overlays 267 and 269 may be coupled to the frame 203 to cover at least part of the frame 203 to provide, for example, one or more select appearances (e.g., textural, structural, etc.) to the frame 203 as desired.

The frame 203 of the bed 201 generally includes a headboard 211, a footboard 213, and two side rails (only one side rail 215 is visible in the figures) coupled between the headboard 211 and the footboard 213 (e.g., using suitable fasteners, connectors, epoxy, constructions, etc.). A mattress platform may be supported by the headboard 211, footboard 213, and/or the side rails 215 for supporting the mattress 205 on the frame 203. The mattress 205 may include any suitable mattress type, size, etc. for use in sitting, lying, etc. on the bed 201.

The illustrated bed 201 includes a headboard overlay 267 and a footboard overlay 269. The headboard overlay 267 is configured (e.g., sized, shaped, constructed, etc.) to be coupled to the headboard 211 of the bed's frame 203, and the footboard overlay 269 is configured (e.g., sized, shaped, constructed, etc.) to be coupled to the footboard 213 of the bed's frame 203. More particularly, the headboard and footboard overlays 267 and 269 are each configured to be coupled to surfaces 271 and 273 (FIG. 7) of the headboard and footboard 211 and 213, respectively. The overlays 267 and 269 cover at least part of the respective surfaces 271 and 273 and thus provide, for example, the one or more select appearances to the frame 203 (e.g., to the headboard 211 and footboard 213, etc.) at the surfaces 271 and 273. Suitable fasteners (e.g., screws, nails, nuts, bolts, hook-and-loop fasteners, clips, etc.), epoxies, ledge features, groove features, other connectors, etc. may be used to couple the headboard and/or footboard overlays 267 and/or 269 to the frame 203 (e.g., to the headboard 211 and footboard 213, etc.) at the respective headboard and footboard surfaces 271 and 273. Alternatively, the headboard and/or footboard overlays 267 and/or 269 may be coupled to the frame 203 without use of fasteners. For example, a press fit coupling, etc. may be used.

The headboard and footboard overlays 267 and 269 may broadly be viewed as overlay assemblies configured to be coupled to the frame 203 of the bed 201. The overlay assemblies may also include one or more fasteners used to couple the overlays 267 and/or 269 to the frame 203 (although fasteners are not required with the assemblies). Overlay assemblies may further include one or more additional components within the scope of the present disclosure.

The illustrated headboard and footboard overlays 267 and 269 may each be generally thin and planar in shape. The headboard overlay 267 may be configured (e.g., sized, shaped, constructed, etc.) to fit substantially between legs 219 of the headboard 211. And the footboard overlay 269 is configured (e.g., sized, shaped, constructed, etc.) to fit substantially between legs 221 of the footboard 213. Lateral sides of each of the overlays 267 and 269 are configured (e.g., sized, shaped, constructed, etc.) to fit closely adjacent the legs 219 and 221 of the respective headboard 211 and footboard 213 (e.g., abut, etc.). An upper portion the headboard overlay 267 is configured (e.g., sized, shaped, constructed, etc.) to fit closely adjacent a rail 275 of the headboard 211; and an upper portion of the footboard overlay 269 is configured (e.g., sized, shaped, constructed, etc.) to fit closely adjacent a rail 231 of the footboard 213. Together, these close fits help substantially cover the surfaces 267 and 269 of the headboard 211 and footboard 213 and, for example, provide the one or more select appearances to the frame 203 at the respective surfaces 267 and 269.

The headboard and footboard overlays 267 and 269 may each be constructed from wood and may each include leather coupled (e.g., tacked, stapled, glued, etc.) thereto to provide a leather overlay surface on each overlay 267 and 269. Other materials and/or combinations of materials may be used to form overlay surfaces within the scope of the present disclosure. For example, overlays may be constructed from wood and then may include fabric, carpet, etc. connected thereto to provide fabric, carpet, etc. overlay surfaces. Also for example, overlays may be constructed from finished wood to provide decorative wood overlay surfaces. As still a further example, overlays may be constructed from laminated materials (e.g., laminated wood, etc.) for use in providing desired overlay surfaces. As another example, overlays may be constructed from wicker, cane, glass, metal, combinations thereof, etc. Further, example overlays may include materials such as rattan, birch, bamboo, etc.

In other example embodiments, furniture assemblies may include only one of a headboard overlay and/or a footboard overlay. In still other example embodiments, furniture assemblies may include one or more overlays covering other surfaces of furniture assembly frames (e.g., surfaces other than headboard surfaces and/or footboard surfaces). In addition, in still other example embodiments overlays may cover only parts of surfaces of furniture assembly frames. In other example embodiments, two or more overlays may be used in combination to cover at least parts of surfaces of furniture assembly frames. In still other example embodiments, overlays may cover two or more surfaces of furniture assembly frames.

Figure 8:
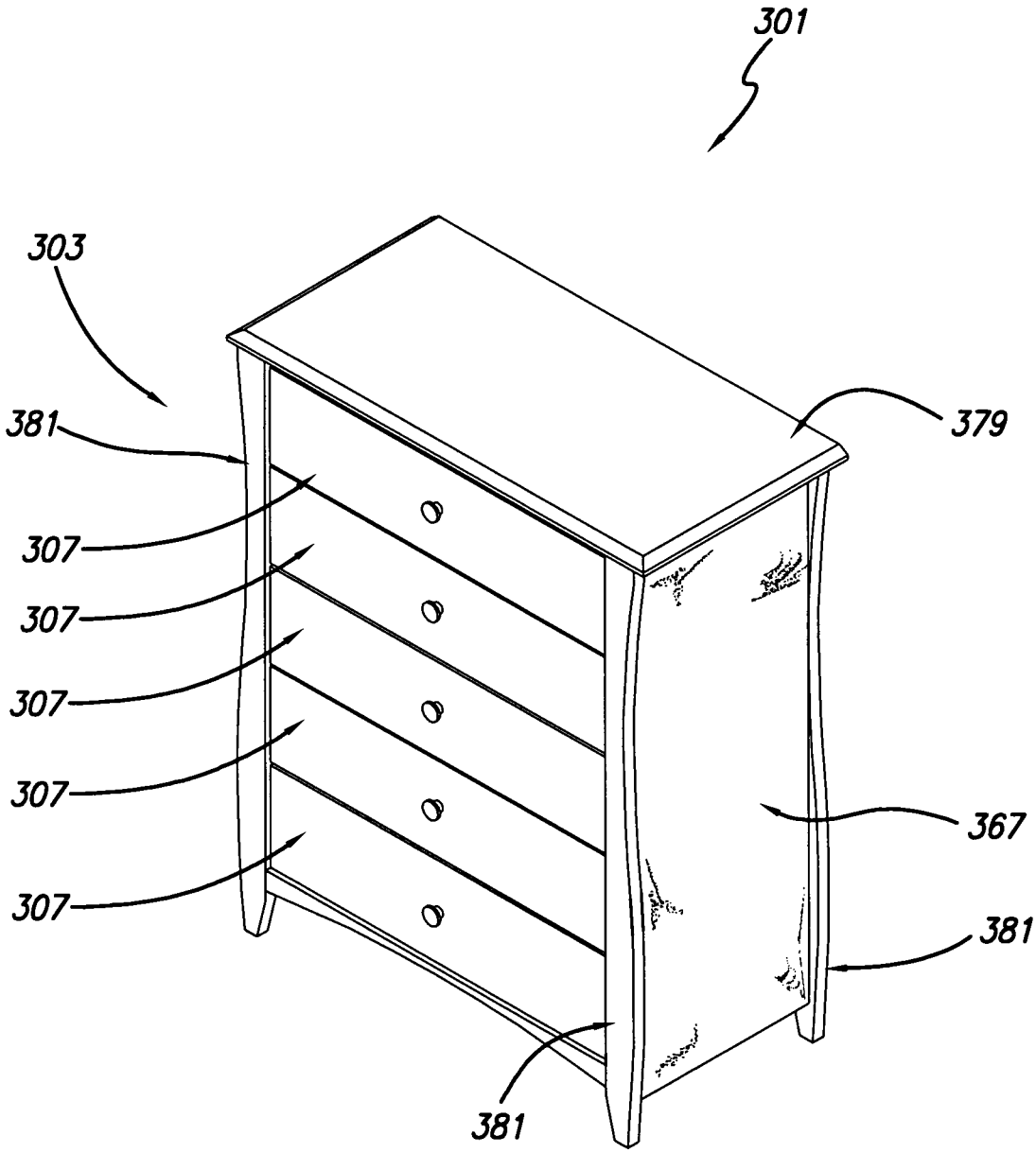
FIG. 8 is an example perspective view of example embodiments of a dresser having an overlay coupled to each side wall of the dresser for providing a select appearance to each of the dresser's side walls.
Figure 9:
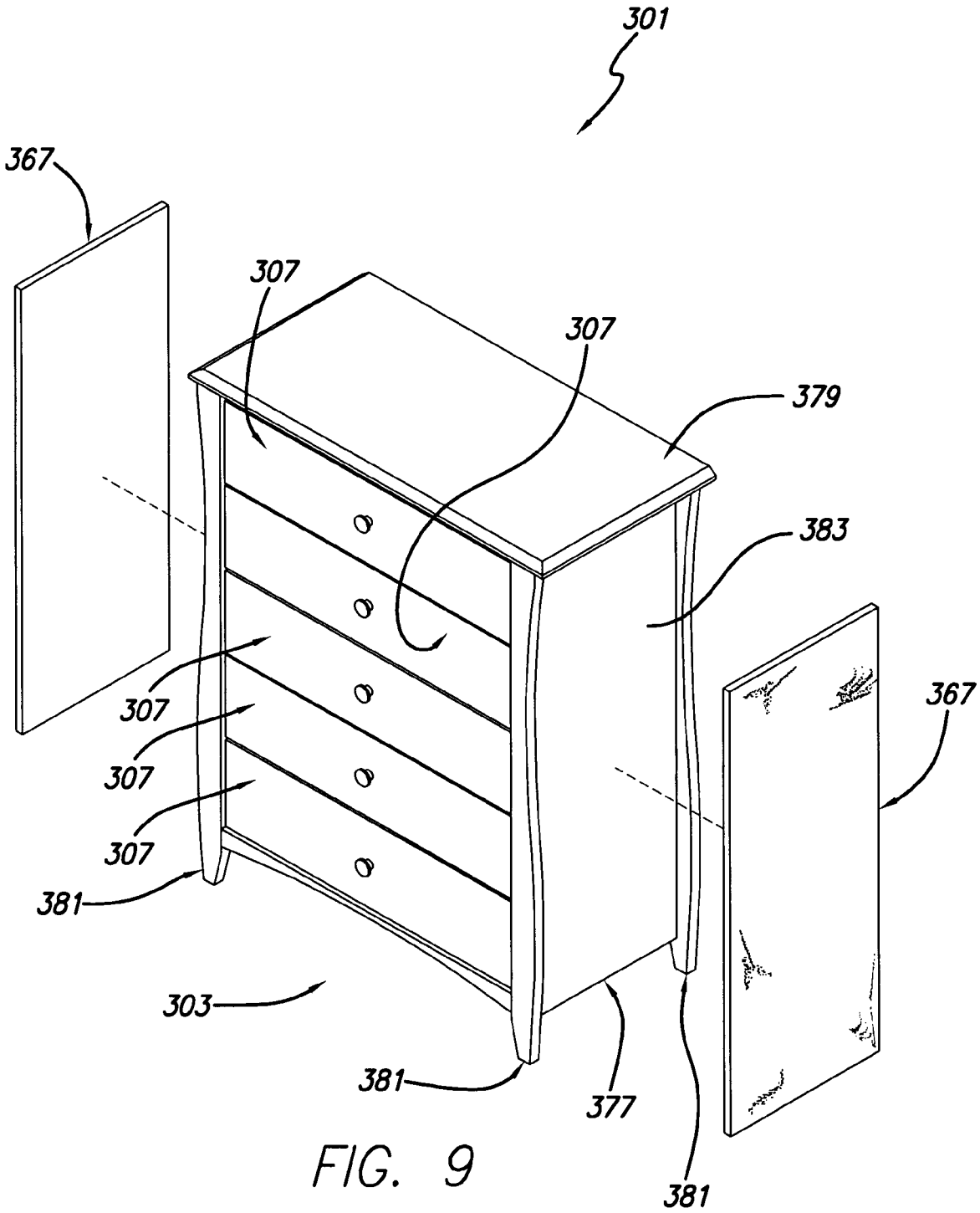
FIG. 9 is an example perspective view similar to FIG. 8 with the overlays each moved away from the dresser.

FIGS. 8 and 9 illustrate example embodiments of a furniture assembly embodying one or more aspects of the present disclosure. In example embodiments, the furniture assembly includes, for example, a dresser 301. The example dresser 301 generally includes a frame 303 and multiple drawers 307 (broadly, storage containers) supported by the frame 303. Two overlays (each indicated at 367) may be coupled to the frame 303 to cover at least part of the frame 303 to provide, for example, one or more select appearances (e.g., textural, structural, etc.) to the frame 303 as desired.

The frame 303 of the dresser 301 generally includes two opposing lateral side walls (FIG. 9, and only one side wall 377 is visible), a rear wall (not visible in the figures), and a cover 379. The side walls 377 are generally positioned between vertical legs (each indicated at 381) of the frame 303, and the rear wall is positioned generally between the two side walls 377 at generally rearward ones of the legs 381. The cover 379 is positioned generally over (and is generally supported by) the side walls 377, the rear wall, and the legs 381, for example, for providing a location to place and/or support items on the dresser 301.

Five drawers 307 may be supported by the dresser's frame 303 in a generally vertical orientation. The drawers 307 may extend through a forward side of the dresser's frame 303 and may be supported by the dressers frame 303 as is generally known. The drawers 307 may be movable relative to the dresser's frame 303 through the forward side of the frame 303 for selectively inserting, removing, etc. items from the drawers 307. In other example embodiments, dressers may include more than or less than five drawers and/or drawers arranged differently than disclosed herein.

The two overlays 367 of the dresser 301 are each configured to be coupled to one of the side walls 377 of the dresser's frame 303. More particularly, the overlays 367 are each configured to be coupled to surfaces (FIG. 9, and each surface is indicated at 383, but only one is visible in the drawings) of respective ones of the dresser's side walls 377. The overlays 367 cover at least part of the respective surfaces 383 and thus provide, for example, the one or more select appearances to the frame 303 (e.g., to the side walls 377, etc.) at the surfaces 383. Suitable fasteners (e.g., screws, nails, nuts, bolts, hook-and-loop fasteners, clips, etc.), epoxies, ledge features, groove features, other connectors, etc. may be used to couple the overlays 367 to the frame 303 (e.g., to the side walls 377, etc.) at the respective side wall surfaces 383. Alternatively, the overlays 367 may be coupled to the frame 303 without use of fasteners. For example, a press fit coupling, etc. may be used.

The illustrated overlays 367 are each generally thin and planar in shape and are each configured (e.g., sized, shaped, constructed, etc.) to fit substantially between the legs 381 at each of the dresser's side walls 377. Lateral sides of each of the overlays 367 are configured (e.g., sized, shaped, constructed, etc.) to fit closely adjacent the respective legs 381 (e.g., abut, etc.), and an upper portion of each of the overlays 367 is configured (e.g., sized, shaped, constructed, etc.) to fit closely adjacent the dresser's cover 379. Together, these close fits help substantially cover the surfaces 383 of the dresser's side walls 377 and, for example, provide the one or more select appearance to the frame 303 at the respective side wall surfaces 383.

The overlays 367 may each be constructed from wood and may each include leather coupled (e.g., tacked, stapled, glued, etc.) thereto to provide a leather overlay surface on each overlay 367. Other materials and/or combinations of materials may be used to form overlay surfaces within the scope of the present disclosure. For example, overlays may be constructed from wood and then may include fabric, carpet, etc. connected thereto to provide fabric, carpet, etc. overlay surfaces. Also for example, overlays may be constructed from finished wood to provide decorative wood overlay surfaces. As still a further example, overlays may be constructed from laminated materials (e.g., laminated wood, etc.) for use in providing desired overlay surfaces. As another example, overlays may be constructed from wicker, cane, glass, metal, combinations thereof, etc. Further, example overlays may include materials such as rattan, birch, bamboo, etc.

In still other example embodiments, overlay assemblies may include overlays and overlay frame structures. The overlay frame structures may be configured (e.g., sized, shaped, constructed, etc.) to be coupled to frames of furniture assemblies for use in coupling the overlays to the furniture assembly frames. The overlays then coupled to the overlay frame structures may cover at least part of the furniture assembly frames to provide, for example, one or more select appearances (e.g., textural, structural, etc.) to the frames as desired. In some example embodiments, overlay assemblies may be coupled to one or more furniture assemblies to allow for matching appearances of the one or more furniture assemblies. Moreover, the overlay assemblies may also allow for matching appearances to one or more other furniture assemblies not including overlays. Such overlay assemblies may thus allow for matching appearances of multiple furniture assemblies not originally constructed to have matching appearances, and without requiring purchasing new pieces of furniture to accomplish the matching appearances.

In other example embodiments, furniture assemblies may include one or more overlays covering other surfaces of frames of the furniture assemblies (e.g., surfaces other than side walls). For example, overlays may cover at least part of rear walls, legs, storage containers, covers, etc.

In further example embodiments, furniture assemblies may include panels having overlays for concealing at least part of spaces under frames of the furniture assemblies. In these embodiments, the panels (and their overlays) may also provide, for example, one or more select appearances (e.g., textural, structural, etc.) to the frames of the furniture assembly at surfaces of the panels.

Figure 10:
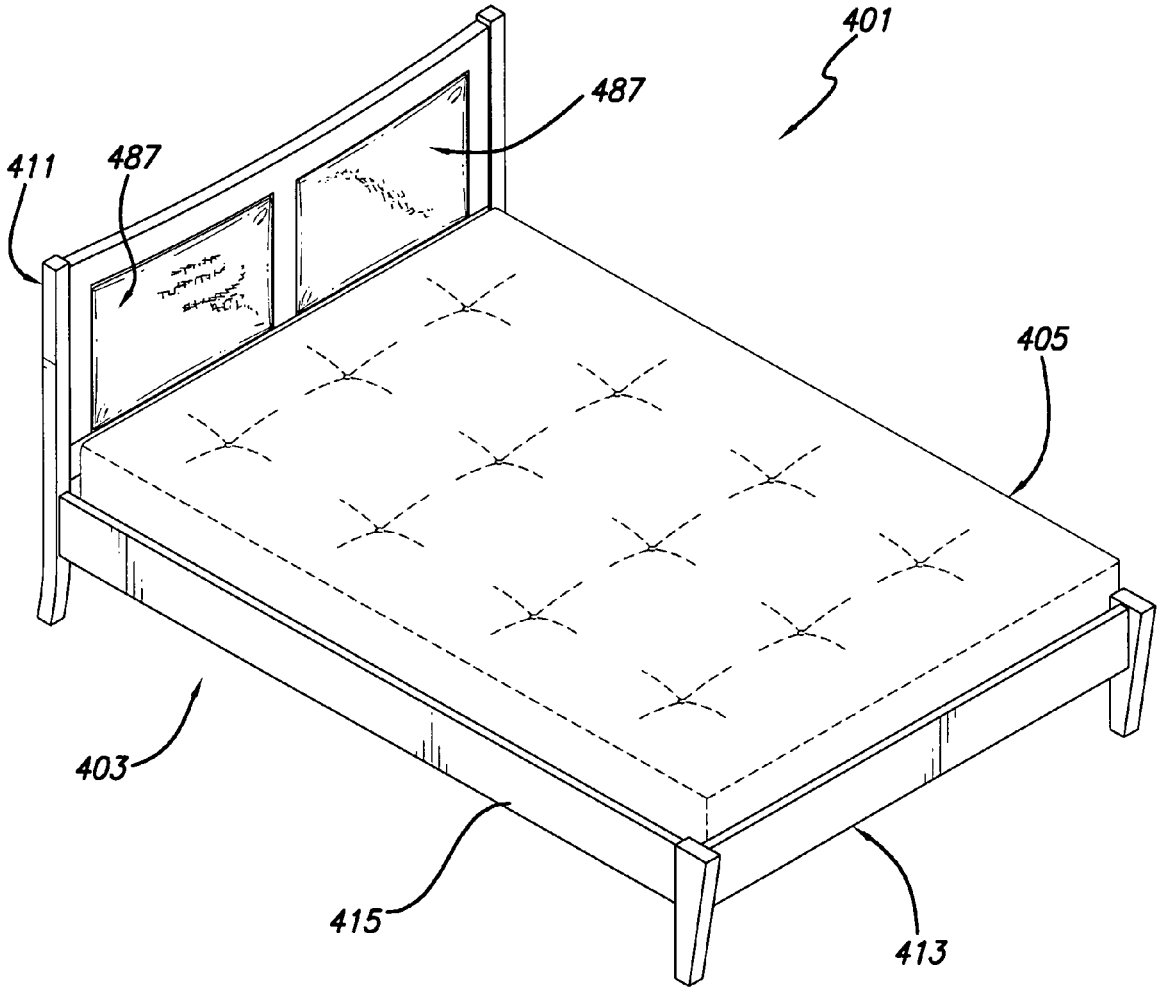
FIG. 10 is an example perspective view of example embodiments of a bed having inserts coupled to a headboard of the bed for providing a select appearance to the headboard.
Figure 11:
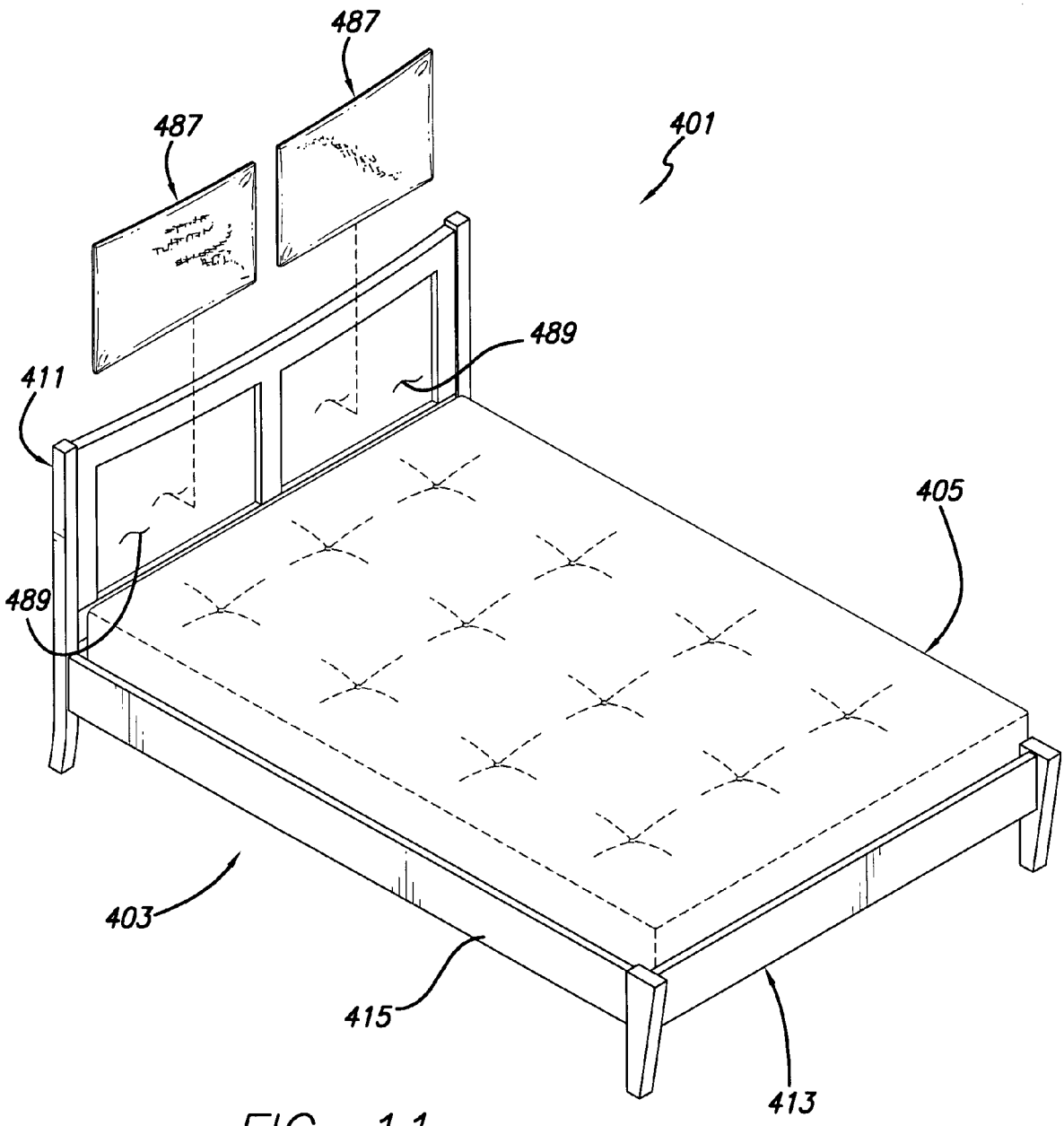
FIG. 11 is an example perspective view similar to FIG. 10 with the inserts each moved away from the bed.

FIGS. 10 and 11 illustrate another example embodiment of a furniture assembly embodying one or more aspects of the present disclosure. In example embodiments, the furniture assembly includes, for example, a bed 401. The example bed 401 generally includes a frame 403 and a mattress 405 supported by the frame 403. Two inserts (each indicated at 487) may be coupled to the frame 403 to provide, for example, one or more select appearances (e.g., textural, structural, etc.) to the frame 403 as desired.

The frame 403 of the bed 401 generally includes a headboard 411, a footboard 413, and two side rails (only one side rail 415 is visible in the figures) coupled between the headboard 411 and the footboard 413 (e.g., using suitable fasteners, connectors, epoxy, constructions, etc.). A mattress platform may be supported by the headboard 411, footboard 413, and/or side rails 415 for supporting the mattress 405 on the frame 403. The mattress 405 may include any suitable mattress type, size, etc. for use in sitting, lying, etc. on the bed 401.

In the illustrated bed 401, the inserts 487 both couple to the headboard 411 of the bed 401 generally at openings (each indicated at 489) formed in the headboard 411 (FIG. 11). More particularly, the inserts 487 are configured (e.g., sized, shaped, constructed, etc.) to be coupled to the headboard 411 generally within the openings 489 to thus provide, for example, the one or more select appearances to the bed's frame 403 (FIG. 10). Suitable fasteners (e.g., screws, nails, nuts, bolts, hook-and-loop fasteners, clips, etc.), epoxies, ledge features, groove features, other connectors, etc. may be used to couple the inserts 487 to the frame 403. Alternatively, the inserts 487 may be coupled to the frame 403 without use of fasteners. For example, a press fit coupling, etc. may be used.

It is to be understood that the inserts 487 may each broadly be viewed as an insert assembly configured to be coupled to the frame 403 of the bed 401. And the insert assemblies may include one or more fasteners used to couple the inserts 487 to the frame 403 (although fasteners are not required with the assemblies). Insert assemblies may also include one or more additional components within the scope of the present disclosure.

The illustrated headboard inserts 487 may each be generally thin and planar in shape, and may be configured (e.g., sized, shaped, constructed, etc.) to fit substantially within the respective openings 489 of the frame's headboard 411 (FIG. 10). In this position, the inserts 487 help, for example, to provide the one or more select appearances to the frame 403, particularly at the headboard 411.

The inserts 487 may each be constructed from wood and may each include leather coupled (e.g., tacked, stapled, glued, etc.) thereto to provide a leather surface on each insert 487. Other materials and/or combinations of materials may be used to form insert surfaces within the scope of the present disclosure. For example, inserts may be constructed from wood and then may include fabric, carpet, etc. connected thereto to provide fabric, carpet, etc. insert surfaces. Inserts may include upholstering, etc. Also for example, inserts may be constructed from finished wood to provide decorative wood insert surfaces. As still a further example, inserts may be constructed from laminated materials (e.g., laminated wood, etc.) for use in providing desired insert surfaces. As another example, inserts may be constructed from wicker, cane, glass, metal, combinations thereof, etc. Further, example inserts may include materials such as rattan, birch, bamboo, etc.

In other example embodiments, furniture assemblies may include, for example, only one insert, or may include three or more inserts. In still other example embodiments, furniture assemblies may include beds having one or more headboard inserts and/or one or more footboard inserts (e.g., inserts coupled to footboards of the beds, etc.). In still other example embodiments, furniture assemblies may include one or more inserts coupled to frames of the furniture assemblies.

In further example embodiments, furniture assemblies may include panels having inserts for concealing at least part of spaces under frames of the furniture assemblies. For example, the panels may include openings therein for receiving the inserts into the openings. In these embodiments, the panels (and their inserts) may also provide, for example, one or more select appearances (e.g., textural, structural, etc.) to the frames of the furniture assemblies.

In still other example embodiments, insert assemblies may include inserts and insert frame structures. The insert frame structures may be configured (e.g., sized, shaped, constructed, etc.) to be coupled to frames of furniture assemblies for use in coupling the inserts to the furniture assembly frames. The inserts then coupled to the frame structures may provide, for example, one or more select appearances (e.g., textural, structural, etc.) to the frames as desired. In some example embodiments, insert assemblies may be coupled to one or more furniture assemblies to allow for matching appearances of the one or more furniture assemblies. Moreover, the insert assemblies may also allow for matching appearances to one or more other furniture assemblies not including inserts, etc. Such insert assemblies may thus allow for matching appearances of multiple furniture assemblies not originally constructed to have matching appearances, and without requiring purchasing new pieces of furniture to accomplish the matching appearances.

It should now be appreciated that panel assemblies, overlay assemblies, and insert assemblies, as disclosed herein, may be coupled to furniture assemblies, for example, after frames of the furniture assemblies are constructed, assembled, etc. For example, customers may retrofit furniture assemblies as desired after purchasing the assemblies with panel assemblies, overlay assemblies, insert assemblies, combinations thereof, etc. This feature allows the customers to later customize, match, etc. the furniture assemblies as desired with other furniture assemblies, motifs, styles, looks, etc. However, it should be understood that the panel assemblies, overlay assemblies, and insert assemblies may be coupled to furniture assemblies by manufacturers, for example during construction, assembling, sale, etc., within the scope of the present disclosure.

Furniture assemblies, as used herein, may include, but should not be limited to, for example, beds, daybeds, futons, dressers, desks, bookcases, shelf structures, tables, foot rests, chests, etc. In addition, one or more components of furniture assemblies may be constructed from wood, metal, combinations thereof, etc. within the scope of the present disclosure. Frames, as used herein, may include, but should not be limited to, for example, any structures of furniture assemblies, for example, headboards, footboards, rails, legs, storage containers, platforms, supports, slats, braces, walls, covers, combinations thereof, etc.

Certain terminology is used herein for purposes of reference only, and thus is not intended to be limiting. For example, terms such as "upper," "lower," "above," "below," "top," "bottom," "upward," "downward," "upwardly," and "downwardly" refer to directions in the drawings to which reference is made. Terms such as "front," "back," "rear," "bottom," and "side," describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second," "third," and other such numerical terms referring to structures do not imply a sequence or order unless clearly indicated by the context.

When introducing elements or features and the example embodiments, the articles "a," "an," "the," and "said" are intended to mean that there are one or more of such elements or features. The terms "comprising," "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The description of the disclosure is merely example in nature and, thus, variations that do not depart from the gist of the disclosure are intended to be within the scope of the disclosure. Such variations are not to be regarded as a departure from the spirit and scope of the disclosure.

What is claimed is:

1. A furniture assembly including a storage container to be moved into and/or out of a space defined by the furniture assembly, the furniture assembly comprising:

a frame;

a platform configured to support a mattress;

the storage container including a front panel; and a removable panel;

wherein the frame includes:

a headboard;

a footboard including a rail;

first and second side rails coupled between the headboard and footboard; and an outer surface configured to engage an inner surface of the front panel of the storage container, the storage container being configured to move horizontally and fit at least partially under the platform;

wherein the platform is supported by one or more of the headboard, footboard, first side rail, and second side rail, wherein the headboard includes a first plurality of legs, wherein the footboard includes a second plurality of legs, wherein the space extends vertically from the platform to lower ends of the first and second plurality of legs and horizontally from the first plurality of legs to the second plurality of legs, wherein the removable panel is configured to couple to the footboard by a plurality of fasteners so as to conceal the storage container when viewed from a footboard end of the furniture assembly, wherein the plurality of fasteners comprises at least four fasteners, each of the at least four fasteners comprising a plate and at least one of nails, screws, an adhesive, and hooks-and-loops, wherein two of the at least four fasteners are spaced and located along a top of the removable panel and secure the removable panel to the footboard rail, wherein one of the remaining at least four fasteners is located proximate to a first bottom corner of the removable panel and secures the removable panel to a first leg of the second plurality of legs, and wherein another one of the remaining at least four fasteners is located proximate to a second bottom corner of the removable panel, opposite the first bottom corner, and secures the removable panel to a second leg of the second plurality of legs.

2. The furniture assembly of claim 1, wherein the storage container is configured to be received at least partly within the space defined by the furniture assembly, and wherein the storage container is independently supported by the frame.

3. The furniture assembly of claim 1, wherein the storage container includes one or more rollers for rolling the storage container relative to the frame.

4. The furniture assembly of claim 3, wherein the removable panel is configured to conceal at least part of the one or more rollers of the storage container.

5. The furniture assembly of claim 1, further comprising:

two or more storage containers configured to be received at least partly within the space defined by the furniture assembly.

6. The furniture assembly of claim 5, wherein each of the storage containers includes one or more rollers configured to roll the respective storage container relative to the frame.

7. The furniture assembly of claim 1, wherein the second plurality of legs includes two legs.

8. The furniture assembly of claim 1, further comprising:

an overlay, coupled to the removable panel, configured to cover at least part of the removable panel;

wherein the overlay is configured to provide one or more select appearances to the removable panel.

9. The furniture assembly of claim 1, wherein the outer surface is part of one of the first and second side rails.

10. The furniture assembly of claim 1, wherein the inner surface of the front panel of the storage container is located at a top of the front panel.

11. The furniture assembly of claim 1, wherein a top of the platform is at a same level as a top of the first and second side rails.

12. The furniture assembly of claim 1, wherein a bottom of the platform is at a higher level than a bottom of the first and second side rails.

13. The furniture assembly of claim 1, wherein a bottom of the rail of the footboard is at a same level as a bottom of the first and second side rails.

14. The furniture assembly of claim 1, wherein when the frame is assembled, the headboard is parallel to the footboard, and wherein when the frame is assembled, the first side rail is parallel to the second side rail.

15. The furniture assembly of claim 1, wherein when the frame is assembled, the legs of the first and second plurality of legs are parallel to each other.

16. A method for concealing at least part of a space defined by a furniture assembly including a storage container to be moved into and/or out of the space under the furniture assembly, the furniture assembly including a frame, a platform configured to support a mattress, the storage container including a front panel, and a removable panel, the frame including a headboard, a footboard including a rail, and first and second side rails coupled between the headboard and footboard, an outer surface configured to engage an inner surface of the front panel of the storage container, the storage container being configured to move horizontally and fit at least partially under the platform, the platform being supported by one or more of the headboard, footboard, first side rail, and second side rail, the headboard including a first plurality of legs, the footboard including a second plurality of legs, the space extending vertically from the platform to lower ends of the first and second plurality of legs and horizontally from the first plurality of legs to the second plurality of legs, the method comprising:

fastening the removable panel to the footboard by a plurality of fasteners;

wherein the removable panel is configured to couple to the frame so that the removable panel does not move relative to the frame and so that the storage container is concealed when viewed from a footboard end of the furniture assembly, wherein the plurality of fasteners comprises at least four fasteners, each of the at least four fasteners comprising a plate and at least one of nails, screws, an adhesive, and hooks-and-loops, wherein two of the at least four fasteners are spaced and located along a top of the removable panel and secure the removable panel to the footboard rail, wherein one of the remaining at least four fasteners is located proximate to a first bottom corner of the removable panel and secures the removable panel to a first leg of the second plurality of legs, and wherein another one of the remaining at least four fasteners is located proximate to a second bottom corner of the removable panel, opposite the first bottom corner, and secures the removable panel to a second leg of the second plurality of legs.

17. A panel assembly for concealing at least part of a space defined by a furniture assembly including a storage container to be moved into and/or out of the space defined by the furniture assembly, the furniture assembly including a frame, a platform configured to support a mattress, the storage container including a front panel, and a removable panel, the frame including a headboard, a footboard including a rail, and first and second side rails coupled between the headboard and footboard, the platform being supported by one or more of the headboard, footboard, first side rail, and second side rail, the headboard including a first plurality of legs, the footboard including a second plurality of legs, the space extending vertically from the platform to lower ends of the first and second plurality of legs and horizontally from the first plurality of legs to the second plurality of legs, an outer surface configured to engage an inner surface of the front panel of the storage container, the storage container being configured to move horizontally and fit at least partially under the platform, the panel assembly comprising:

a removable panel configured to extend generally between the first plurality of legs or the second plurality of legs so as to conceal at least part of the space defined by the furniture assembly, the removable panel being configured to conceal the storage container when viewed from a footboard end of the furniture assembly; and a plurality of fasteners that couple the removable panel to the headboard or the footboard;

wherein the plurality of fasteners couple the removable panel to the respective headboard or the footboard so that the removable panel does not move relative to the frame, wherein the plurality of fasteners comprises at least four fasteners, each of the at least four fasteners comprising a plate and at least one of nails, screws, an adhesive, and hooks-and-loops, wherein two of the at least four fasteners are spaced and located along a top of the removable panel and secure the removable panel to a lateral brace extending between the legs of a selected one of either the first or the second plurality of legs, wherein one of the remaining at least four fasteners is located proximate to a first bottom corner of the removable panel and secures the removable panel to a first leg of the selected plurality of legs, and wherein another one of the remaining at least four fasteners is located proximate to a second bottom corner of the removable panel, opposite the first bottom corner, and secures the removable panel to a second leg of the selected plurality of legs.

18. The panel assembly of claim 17, further comprising:

an overlay, coupled to the panel, configured to cover at least part of the removable panel;

wherein the overlay is configured to provide one or more select appearances to the removable panel.

19. The panel assembly of claim 17, wherein the removable panel is configured to extend generally between the second plurality of legs.

20. A furniture assembly including a storage container to be moved into and/or out of a space defined by the furniture assembly, the furniture assembly comprising:

a frame, the frame including a headboard, a footboard including a rail, and an outer surface configured to engage an inner surface of the storage container, the storage container configured to move horizontally, the storage container and the frame being independently supported from one another;

a platform configured to support a mattress; and a removable panel;

wherein the platform is supported by the frame, wherein the space extends vertically from the platform to lower ends of the legs and horizontally from a first plurality of legs at a headboard end of the frame to a second plurality of legs at a footboard end of the frame, wherein the removable panel is configured to couple to the footboard by a plurality of fasteners so as to conceal the storage container when viewed from a footboard end of the frame, wherein the plurality of fasteners comprises at least four fasteners, each of the at least four fasteners comprising a plate and at least one of nails, screws, an adhesive, and hooks-and-loops, wherein two of the at least four fasteners are spaced and located along a top of the removable panel and secure the removable panel to the footboard rail, wherein one of the remaining at least four fasteners is located proximate to a first bottom corner of the removable panel and secures the removable panel to a first leg of the second plurality of legs, and wherein another one of the remaining at least four fasteners is located proximate to a second bottom corner of the removable panel, opposite the first bottom corner, and secures the removable panel to a second leg of the second plurality of legs.

21. A furniture assembly including a storage container to be moved into and/or out of a space defined by the furniture assembly, the furniture assembly comprising:

a daybed frame;

a platform configured to support a mattress; and a removable panel;

wherein the frame includes:

a headboard and a footboard;

first and second arm supports; and first and second border rails coupled between the arm supports;

wherein the platform is supported by one or more of the first arm support, the second arm support, the first border rail, and the second border rail, and at least one of the first and second border rails are configured to engage an inside surface of a front panel of the storage container, the storage container being configured move horizontally and fit at least partially under the platform, wherein the first arm support includes a first plurality of legs, wherein the second arm support includes a second plurality of legs, wherein the space extends vertically from the platform to lower ends of the first and second plurality of legs and horizontally from the first plurality of legs to the second plurality of legs, wherein the removable panel is coupled to the footboard by a plurality of fasteners so as to conceal the storage container when viewed from a footboard end of the frame, wherein the plurality of fasteners comprises at least four fasteners, each of the at least four fasteners comprising a plate and at least one of nails, screws, an adhesive, and hooks-and-loops, wherein two of the at least four fasteners are spaced and located along a top of the removable panel and secure the removable panel to a lateral brace extending between the legs of the second plurality of legs, wherein one of the remaining at least four fasteners is located proximate to a first bottom corner of the removable panel and secures the removable panel to a first leg of the second plurality of legs, and wherein another one of the remaining at least four fasteners is located proximate to a second bottom corner of the removable panel, opposite the first bottom corner, and secures the removable panel to a second leg of the second plurality of legs.

22. A furniture assembly including a storage container to be moved into and/or out of a space defined by the furniture assembly, the furniture assembly comprising:

a daybed frame having a headboard, a footboard including a rail, and at least one rail configured to engage an inside surface of a front panel of the storage container, the storage container being configured to move horizontally and fit at least partially under a platform;

a platform configured to support the mattress; and a removable panel;

wherein the platform is supported by the daybed frame, wherein the daybed frame includes a first plurality of legs and a second plurality of legs, wherein the space extends vertically from the platform to lower ends of the legs and horizontally from the first plurality of legs at a headboard end of the frame to the second plurality of legs at a footboard end of the frame, wherein the removable panel is coupled to the footboard by a plurality of fasteners so as to conceal the storage container when viewed from a footboard end of the frame, wherein the plurality of fasteners comprises at least four fasteners, each of the at least four fasteners comprising a plate and at least one of nails, screws, an adhesive, and hooks-and-loops, wherein two of the at least four fasteners are spaced and located along a top of the removable panel and secure the removable panel to a lateral brace extending between the legs of the second plurality of legs, wherein one of the remaining at least four fasteners is located proximate to a first bottom corner of the removable panel and secures the removable panel to a first leg of the second plurality of legs, and wherein another one of the remaining at least four fasteners is located proximate to a second bottom corner of the removable panel, opposite the first bottom corner, and secures the removable panel to a second leg of the second plurality of legs.

* * * * *